US007294029B1

(12) United States Patent
Spaulding

(10) Patent No.: US 7,294,029 B1
(45) Date of Patent: Nov. 13, 2007

(54) MOUNT APPARATUS FOR A TROLLING MOTOR

(75) Inventor: Jeffrey S. Spaulding, Tulsa, OK (US)

(73) Assignee: Brunswick Corporation, Lake Forest, IL (US)

( * ) Notice: Subject to any disclaimer, the term of this patent is extended or adjusted under 35 U.S.C. 154(b) by 52 days.

(21) Appl. No.: 11/415,298

(22) Filed: May 1, 2006

(51) Int. Cl.
*B63H 5/20* (2006.01)
*B60L 11/00* (2006.01)

(52) U.S. Cl. ..... 440/53; 440/6

(58) Field of Classification Search ..... 440/6, 440/53

See application file for complete search history.

(56) References Cited

U.S. PATENT DOCUMENTS

| | | | | | |
|---|---|---|---|---|---|
| 3,750,988 | A | | 8/1973 | Lyon | 248/4 |
| 3,765,369 | A | | 10/1973 | Henning | 115/17 |
| 3,861,628 | A | * | 1/1975 | Krieger | 248/642 |
| 3,865,335 | A | * | 2/1975 | Roller et al. | 248/642 |
| 3,954,080 | A | | 5/1976 | Weaver | 115/17 |
| 3,980,039 | A | | 9/1976 | Henning | 115/41 R |
| 3,999,500 | A | | 12/1976 | Friedel et al. | 115/17 |
| 4,008,680 | A | * | 2/1977 | Alexander, Jr. | 440/6 |
| 4,019,703 | A | | 4/1977 | Meredith et al. | 248/4 |
| 4,154,417 | A | | 5/1979 | Foley | 248/640 |
| 4,634,390 | A | * | 1/1987 | Baird | 440/63 |
| 4,708,670 | A | * | 11/1987 | Peters | 440/6 |
| 4,729,745 | A | | 3/1988 | Edwards | 440/6 |
| 4,819,905 | A | | 4/1989 | McCain | 248/642 |
| 4,875,656 | A | | 10/1989 | Boede | 248/642 |
| 4,966,566 | A | * | 10/1990 | Baird | 440/6 |
| 5,005,798 | A | | 4/1991 | McCoy | 248/642 |
| 5,112,258 | A | * | 5/1992 | Folsom | 440/63 |
| 5,116,267 | A | * | 5/1992 | Olson | 440/56 |
| 5,174,542 | A | | 12/1992 | DeLeeuw | 248/640 |
| 5,277,630 | A | * | 1/1994 | Clark | 440/6 |
| 5,509,835 | A | | 4/1996 | Henderson et al. | 440/63 |
| 5,669,794 | A | * | 9/1997 | Knight et al. | 440/63 |
| 5,725,401 | A | | 3/1998 | Smith | 440/6 |
| 6,053,781 | A | | 4/2000 | Littleton | 440/62 |
| 6,224,437 | B1 | * | 5/2001 | Griffith et al. | 440/53 |
| 6,325,685 | B1 | * | 12/2001 | Knight et al. | 440/7 |
| 6,431,923 | B1 | | 8/2002 | Knight et al. | 440/6 |
| 6,447,347 | B1 | | 9/2002 | Steinhauser | 440/1 |
| 2005/0020150 | A1 | | 1/2005 | Bernloehr | 440/58 |
| 2005/0255761 | A1 | | 11/2005 | Bernloehr et al. | 440/6 |

* cited by examiner

*Primary Examiner*—Jesus Sotelo
*Assistant Examiner*—Daniel V. Venne
(74) *Attorney, Agent, or Firm*—William D. Lanyi

(57) ABSTRACT

A mount apparatus for a trolling motor provides latching positions for the stowed and deployed conditions of the trolling motor. Locking the mechanism in either the stowed or deployed positions is accomplished solely by moving the shaft of the trolling motor assembly in a lever-like movement about a pivot axis which extends through the base and transmission structure of the mount apparatus. This locking procedure is accomplished without the necessity of moving the shaft in a direction which is generally parallel to its central axis. As a result, the locking movement required by an operator to latch the trolling motor in its deployed and stowed positions is ergonomically preferable to known types of systems.

12 Claims, 12 Drawing Sheets

MOUNT APPARATUS FOR A TROLLING MOTOR

BACKGROUND OF THE INVENTION

1. Field of the Invention

The present invention is generally related to a trolling motor and, more particularly, to a mount apparatus which significantly facilitates the locking and unlocking of the trolling motor in its stowed and deployed positions.

2. Description of the Related Art

Those skilled in the art of trolling motors are familiar with many different types of mounting techniques for supporting a trolling motor with respect to a marine vessel.

U.S. Pat. No. 3,750,988, which issued to Lyon on Aug. 7, 1973, describes a motor mount for securing an electric trolling motor or the like to the bow portion of a boat which includes a motor mounting plate secured to a folding frame structure. The folding frame structure is removably secured to the bow portion of the boat by means of a pair of mutually engageable wedge-type brackets fixedly secured respectively to the frame structure and the bow portion of the boat. A latch is carried by the folding frame to secure the relatively movable members thereof in operating position. The motor mounting plate is sized such that it provides positive securement of the motor mount to the bow portion of the boat when the motor mount is latched in the operating position.

U.S. Pat. No. 3,765,369, which issued to Henning on Oct. 16, 1973, describes a bow mount for trolling motors. The device has a base member adapted to be secured to a boat. One end of a swing arm is mounted from the base member so as to permit the swing arm to rotate through approximately 180 degrees from driving and storing positions. A bracket is attached to the other end of the swing arm for at least partial rotation with respect thereto, and a trolling motor is selectively positionable in the bracket to accommodate vertical adjustment of the trolling motor.

U.S. Pat. No. 3,865,335, which issued to Roller et al. on Feb. 11, 1975, describes a bow bracket mounting for an electric trolling motor. The bracket includes a base member having a pair of upstanding c-shaped members on the forward end thereof. A pivot arm is hinged at the rear of the base and is equipped at the forward end with a trolling motor shaft holding bracket which is hinged for limited pivotal movement with respect to the arm. A remotely releasable latch is mounted on the forward end of the arm to lock the motor shaft in an operating position, but is releasable to permit movement of the trolling motor to a storage position wherein the motor shaft is horizontally disposed and the motor and prop unit is received by the c-members. In the storage position, a locking bolt eliminates movement of the arm relative to the base and in the operating position, a toggle biases the arm to engagement with the base.

U.S. Pat. No. 3,954,080, which issued to Weaver on May 4, 1976, describes a bow mount for trolling motors. A linkage including a bracket for mounting a trolling motor on the bow or deck of a boat for swinging between operating and stowed positions is described. A releasable locking mechanism is provided for locking the motor in either position, and the release from one position and translation to the other position is accomplished by a single action on the part of the operator.

U.S. Pat. No. 3,980,039, which issued to Henning on Sep. 14, 1976, describes an electrically operated bow mount for a trolling motor. A motor tube carrying the trolling motor at one end and a steering motor at the other end is mounted on a plate detachably supported on the bow or deck of a boat. A gear driven by an electric motor is mounted on the mounting plate and meshes with a rack on the motor tube to raise and lower it in vertical position, and raising the motor tube a predetermined amount trips a latch on the plate to allow the motor tube to rotate bodily with the gear to a horizontal stowed position on the boat.

U.S. Pat. No. 3,999,500, which issued to Friedel et al. on Dec. 28, 1976, describes a pivotal support lock apparatus for trolling motor apparatus. A pivotal mount for a trolling motor includes a deck bracket having a housing arm pivotally mounted at one end. A gear mechanism within the arm has a fixed bevel gear on the pivot arm axis meshing with a bevel gear on a rotatable torque tube. A drive bevel gear is secured to the opposite end and meshes with a gear selector on a coupling head pivotally mounted in the outer end of the arm.

U.S. Pat. No. 4,008,680, which issued to Alexander on Feb. 22, 1977, discloses a pivotal mounting assembly for trolling motors. The mount includes a deck bracket having a housing arm pivotally mounted at one end. A gear mechanism within the arm has a fixed bevel gear on the pivot arm axis meshing with a bevel gear on a rotatable torque tube. A drive bevel gear is secured to the opposite end and meshes with a gear selector on a coupling head pivotally mounted in the outer end of the arm.

U.S. Pat. No. 4,019,703, which issued to Meredith et al. on Apr. 26, 1977, describes a trolling motor safety mount. It includes a clamp for attachment to the stern of a boat, a hollow mounting block pivotally mounted to the clamp, a detent arrangement disposed within the interior area defined by the block and for normally maintaining the block in abutting relationship with the clamp, and a latch for latching the motor out of the water.

U.S. Pat. No. 4,154,417, which issued to Foley on May 15, 1979, describes an adjustable mount for a trolling motor. A mounting bracket for an outboard electric trolling motor has center and side arms for moving and supporting a propulsion motor, as for a fishing boat, between a submerged, outboard operating position and a retracted inboard, locked and secured storage position on the deck of the boat. An adjustment linkage is interposed between pivot axes on the side arms of the bracket for adjustment of the orientation of the motor shaft in the retracted storage position.

U.S. Pat. No. 4,729,745, which issued to Edwards on Mar. 8, 1988, describes a quick release assembly for electric troller motors. The motor tube is held in a swivel bracket that in turn is operatively connected to the mounting bracket secured to the bow or transom of the boat. A quick release pin provides one pivot for the connection between the swivel bracket and the mounting bracket, while a thrust pin provides the other connection with a movable retainer plate allowing quick release of the swivel bracket from the mounting bracket after the quick release pivot pin is removed.

U.S. Pat. No. 4,819,905, which issued to McCain on Apr. 11, 1989, describes a trolling motor mount for pleasure boats. An adjustable bracket mounting support for mounting an electric trolling motor on the forward end of a pleasure boat which includes a base member supported by two adjustable length arms which are attached to slidable clamps mounted on the bow rails of the boat and a downwardly extending support leg which attaches to the bow eye of the boat is described. A motor mount plate is rotatably mounted on the base plate and is adapted for receiving the mounting bracket assembly of a remotely controlled electric trolling motor. The supporting arm and legs of the mount are of the telescoping type which allows an infinite amount of length adjustment to properly position the motor mount as desired either over or beyond the front edge of the boat.

U.S. Pat. No. 4,875,656, which issued to Boede on Oct. 24, 1989, discloses a stowable pull handle for electric trolling motor support apparatus. The manual operating cord for a deck mounted electric trolling motor includes a handle which is demountably attachable to an arm of the pivotal motor support apparatus when the motor is in the operative or stowed position. The demountable handle assures that the operating cord will always be readily accessible to the operator in the boat to either raise the motor from its operative position or lower it thereto from its stowed position on the deck.

U.S. Pat. No. 5,005,798, which issued to McCoy on Apr. 9, 1991, describes a trolling motor mount. A mount for dynamically attaching an auxiliary trolling motor at a user-selective position over the gunwale, transom, or stern of a fishing boat is described. The mount comprises a rigid bracket secured by a screw clamp to the wall of the boat. The bracket comprises a pair of sides spaced apart by a planar top. A bottom projects inwardly toward the open interior of the bracket. An adjustable base associated with the bracket bottom provides width compensation to accommodate different mounting surfaces.

U.S. Pat. No. 5,174,542, which issued to DeLeeuw on Dec. 29, 1992, describes a secure mount for a trolling motor. An improved mount for securing a trolling motor to a boat includes a slide plate, a base plate, stop, and a thumb screw. If desired, the mount can be positively secured with a lock against possible unauthorized removal or theft.

U.S. Pat. No. 5,509,835, which issued to Henderson et al. on Apr. 23, 1996, discloses a trolling motor quick stowage device. The device is provided which allows the trolling motor to be longitudinally raised and held in place. The stowage device has a collar, such as a U-bolt, which fits around the trolling motor shaft. The closed end of the collar is rigidly attached to a supporting structure, such as a boat hull or attachment to the hull. A cam is rotatably attached to the collar so that it can engage the trolling motor shaft.

U.S. Pat. No. 5,725,401, which issued to Smith on Mar. 10, 1998, describes a trolling motor tilt trigger. A trigger lever is attached pivotally at a fulcrum section to an outside portion of a steering housing that tilts on a troll motor clamp of a conventional troll motor assembly. A latch release line that is pulled from a select position on a steering handle presses a press end of a latch release rod to release a crossbar latch from engagement with ratchet slots in quarter circle edges of juxtaposed ratchet plates.

U.S. Pat. No. 6,053,781, which issued to Littleton on Apr. 25, 2000, describes a steering device for a trolling motor. An auxiliary steering device for a trolling motor employing a steering block attached to the directional shaft of the trolling motor that is connected via a continuous cable to a pivoting stick positioned on the gunwale of a boat is described. The stick, working in combination with the directional shaft, provides remote steering of an outboard trolling motor. Remote steering enables the operator to be seated in a central location within the boat and to observe the condition of the water immediately in front of the bow.

U.S. Pat. No. 6,431,923, which issued to Knight et al. on Aug. 13, 2002, describes a trolling motor bow mount. The bow mount and a method for releasably mounting a trolling motor to a bow of a boat are disclosed. The bow mount includes a base, a chassis, an actuation mechanism between the chassis and the base and a retaining mechanism. The base is adapted to be mounted to a bow of a boat and includes a pair of longitudinally extending spaced side channels. The chassis is adapted to be coupled to the trolling motor and includes a pair of spaced longitudinally extending side projections. The actuation mechanism is positioned between the chassis and the base and is configured to move at least one of the side projections and the side channels in a transverse direction relative to one another such that the projections extend into the channels.

U.S. Pat. No. 6,447,347, which issued to Steinhauser on Sep. 10, 2002, describes a trolling motor position responsive system. The system is disclosed that warns and/or prevents a power boat operator from engaging an outboard motor while the trolling motor remains deployed in the water. The system comprises a trolling motor positioned sensor that is in communication with an ignition switch, wherein the sensor activates and alarm and/or an ignition disabling switch when an operator attempts to engage the outboard motor when the trolling motor remains deployed in the water.

U.S. patent application Ser. No. 10/864,299, which was filed by Bernloehr on Jun. 9, 2004, describes a trolling motor assembly. The assembly is intended for use with a watercraft. The trolling motor assembly comprises a propulsion unit, a steering control unit, a motor tube, and a mount system having a first portion adapted to be mounted to a watercraft and a second portion adapted to support the propulsion unit. The assembly further comprises an orientation system which is configured to reindex the trolling motor assembly between a forward troll position and a back troll position.

U.S. patent application Ser. No. 10/847,218, which was filed by Bernloehr et al. on May 17, 2004, describes a trolling motor mount. The trolling motor comprises a head portion, a propulsion unit, a shaft coupling the propulsion unit to the head portion, and a mounting system configured to secure the trolling motor to the watercraft and to pivot the trolling motor between a deployed position and a stowed position. The mount system comprises a base having a first portion adapted to be mounted to the watercraft and a second portion adapted to receive the trolling motor, a pivot member coupled to the base and configured to pivot between the deployed position and the stowed position, and a damper mechanism coupled to the pivot member and configured to impede the movement of the member as the pivot member is being moved between the deployed position and the stowed position.

The patents described above are hereby expressly incorporated by reference in the description of the present invention.

It would be significantly beneficial if a trolling motor mount apparatus could be provided which simplifies the locking of the system into deployed and stowed positions and provides a more ergonomic exertion of force, on the part of the operator, to accomplish the locking and unlocking of the trolling motor mount apparatus into the stowed and deployed positions.

SUMMARY OF THE INVENTION

A trolling motor mount apparatus made in accordance with a preferred embodiment of the present invention comprises a base which is attachable to a marine vessel, a transmission structure which is pivotally attached to the base for rotation about a pivot axis, a shaft supported by the transmission structure for movement, relative to the transmission structure, in a direction which is generally parallel to a central axis of the shaft, a motor attached to the shaft, and a first retention mechanism for retaining the shaft in a stowed position relative to the base. The first retention mechanism is lockable in the stowed position by movement of the shaft in a first rotational direction about the pivot axis.

In a particularly preferred embodiment of the present invention, the pivot axis extends through the transmission structure and the pivot axis is disposed in non-intersecting relation with the central axis.

A preferred embodiment of the present invention can further comprise a cradle structure shaped to receive the motor therein when the shaft is in the stowed position. The cradle structure comprises an internal receiving surface which has a radius of curvature which is smaller than an outer surface of the motor. The cradle structure comprises at least one arm which is sufficiently flexible to accommodate the outer surface of the motor being larger than the radius of curvature of the inner receiving surface.

A preferred embodiment of the present invention can further comprise a second retention mechanism for retaining the shaft in a deployed position relative to the base. The second retention mechanism is lockable in the deployed position by movement of the shaft in a second rotational direction about the pivot axis. The first and second retention mechanisms are configured to be actuated to retain the shaft in the stowed and deployed positions, respectively, solely by movement of the shaft in the first and second rotational directions about the pivot axis, respectively, without the need for the shaft to be moved in the direction which is generally parallel to the central axis. The preferred embodiment of the present invention can further comprise a latch component pivotally attached to the transmission structure for movement about a release axis. The latch component comprises a latching surface which is shaped to be received in a first slot formed in the base when the latch component is rotated in a latching direction about the release axis and shaped to be removed from the first slot when the latch component is rotated in an unlatching direction about the release axis. The latching surface of the latch component is also shaped to be received in a second slot formed in the base when the latch component is rotated in a latching direction about the release axis and shaped to be removed from the second slot when the latch component is rotated in an unlatching direction about the release axis. The present invention can further comprise a spring for urging the latch component in the latching direction about the release axis.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
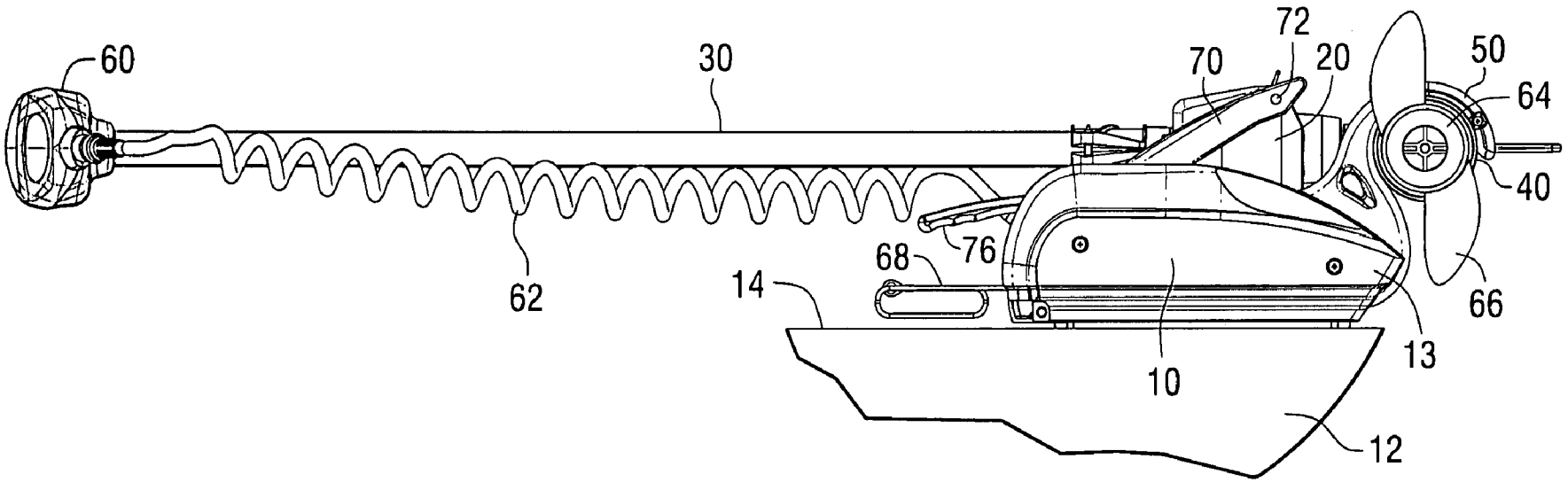
FIG. 1 shows a trolling motor in a stowed position.

Throughout the description of the preferred embodiment of the present invention, like components will be identified by like reference numerals.

FIG. 1 shows a preferred embodiment of the trolling motor mount apparatus of the present invention. It comprises a base 10 which is attachable to a marine vessel 12. In a typical application of the present invention, the base 10 is rigidly attached to a generally horizontal surface 14 of a deck portion of the marine vessel 10. A transmission structure 20 is pivotally attached to the base portion 10 about a pivot axis 24 which is illustrated in FIG. 2.

Figure 2:
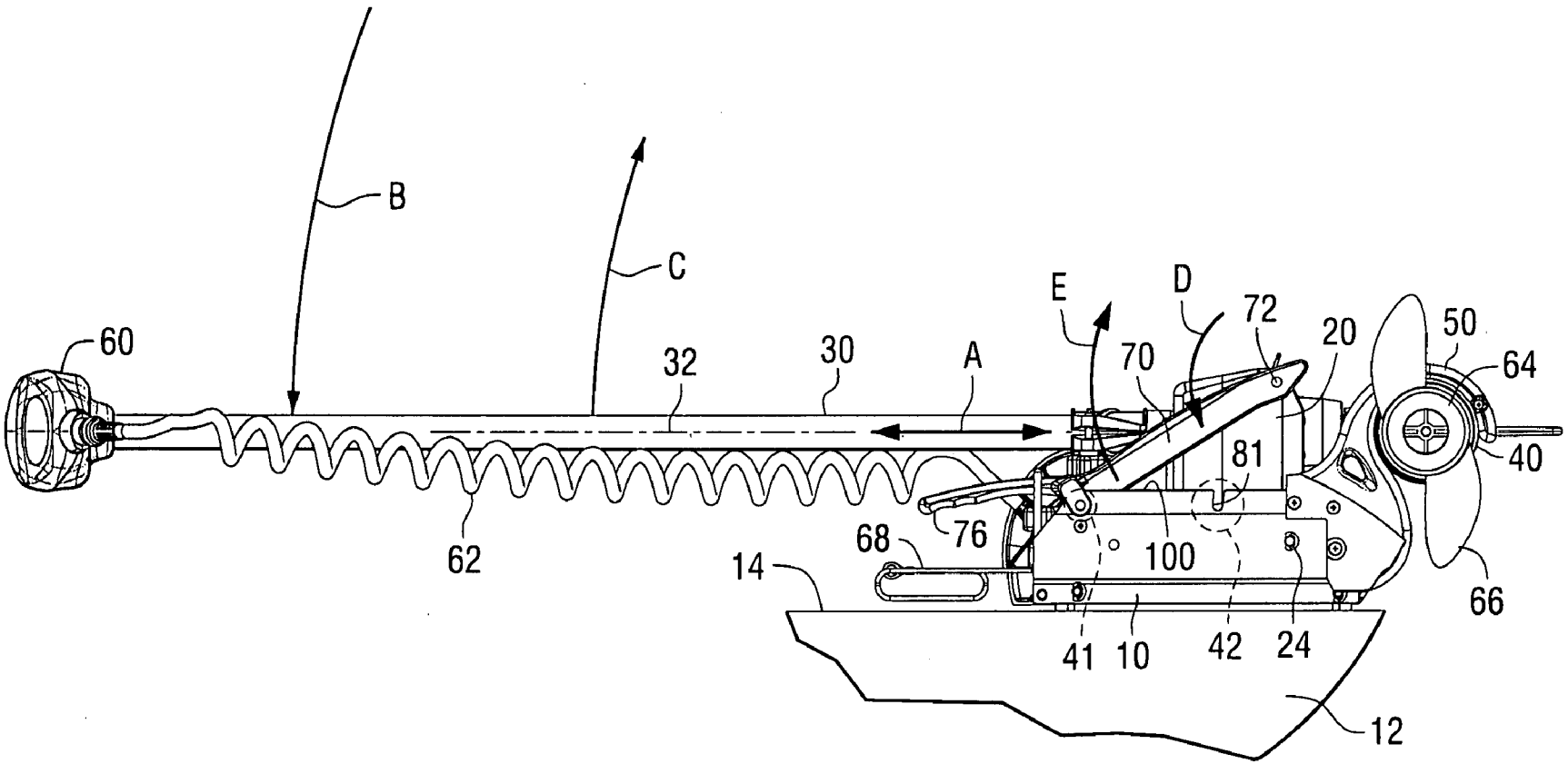
FIG. 2 is generally similar to FIG. 1, but with a cover removed to expose certain internal components of the base.

FIGS. 1 and 2 show the trolling motor of the present invention in a stowed position. The difference between FIGS. 1 and 2 is that FIG. 1 shows the base 10 with a cover plate 13 attached to it while FIG. 2 shows the base 10 with the cover plate removed. In FIG. 2, the absence of the cover plate 13 exposes the location of the pivot axis 24.

With continued reference to FIGS. 1 and 2, the trolling motor mount apparatus further comprises a shaft 30 which is supported by the transmission structure 20 for movement, relative to the transmission structure, in a direction which is generally parallel to a central axis 32 of the shaft 30. This movement is identified by arrow A. A motor 40 is attached to the shaft 30. A first retention mechanism 41 is provided for retaining the shaft 30 in the stowed position, shown in FIGS. 1 and 2, relative to the base 10. The first retention mechanism 41 is lockable in the stowed position by movement of the shaft 30 in a first rotational direction, represented by arrow B, about the pivot axis 24. This relationship between the pivot axis 24 and the transmission structure 20 is more apparent in FIGS. 10, 12 and 13, as will be described below. The pivot axis 24 is disposed in non-intersecting relation with the central axis 32 in a preferred embodiment of the present invention. This relationship is also illustrated in FIG. 2.

A cradle structure 50 is shaped to receive the motor 40 therein when the shaft 30 is in the stowed position, as illustrated in FIGS. 1 and 2.

With continued reference to FIGS. 1 and 2, other components of the trolling motor assembly are illustrated. For example, the head 60 is at an end of the shaft 30 which is opposite to the end at which the motor 40 is attached. A cable 62 extends from the head 60 to the base 10. The motor 40 is provided with a propeller 64 having two blades 66 as illustrated in FIGS. 1 and 2. An electrical connection 68 is provided to connect the electrical components of the trolling motor assembly to a battery or other source of electrical power. A second retention mechanism 42 is provided for retaining the shaft 30 in a deployed position relative to the base in a manner which will be described in greater detail below. The second retention mechanism 42 is lockable in the deployed position by movement of the shaft 30 in a second rotational direction C about the pivot axis 24. The first and second retention mechanisms, 41 and 42, are configured to be actuated to retain the shaft 30 in the stowed and deployed positions, respectively, solely by movement of the shaft 30 in the first and second rotational directions about the pivot axis 24, respectively, without the need for the shaft 30 to be moved in the direction A which is generally parallel to the central axis 32.

With continued reference to FIGS. 1 and 2, a latch component 70 is pivotally attached to the transmission structure 20 for movement about a release axis 72. The latch component 70 comprises a latching surface, which will be described in greater detail below in conjunction with FIG. 12, which is shaped to be received in a first slot 80. The first slot 80 is not visible in FIG. 2, but will be described in greater detail below in conjunction with FIG. 3. The first slot 80 is formed in the base 10. The latching surface of the latch component is received in the first slot 80 in order to lock the trolling motor shaft 30 in its stowed position. In order to accomplish this locking function, the latch component 70 is rotated in a latching direction D about the release axis 72. In addition, the latching surface of the latch component 70 is shaped to be removed from the first slot 80 when the latch component 70 is rotated in an unlatching direction E about the release axis 72. A grip portion 76 is provided to facilitate this rotation of the latch component 70 about the release axis 72 by the operator.

Figure 3:
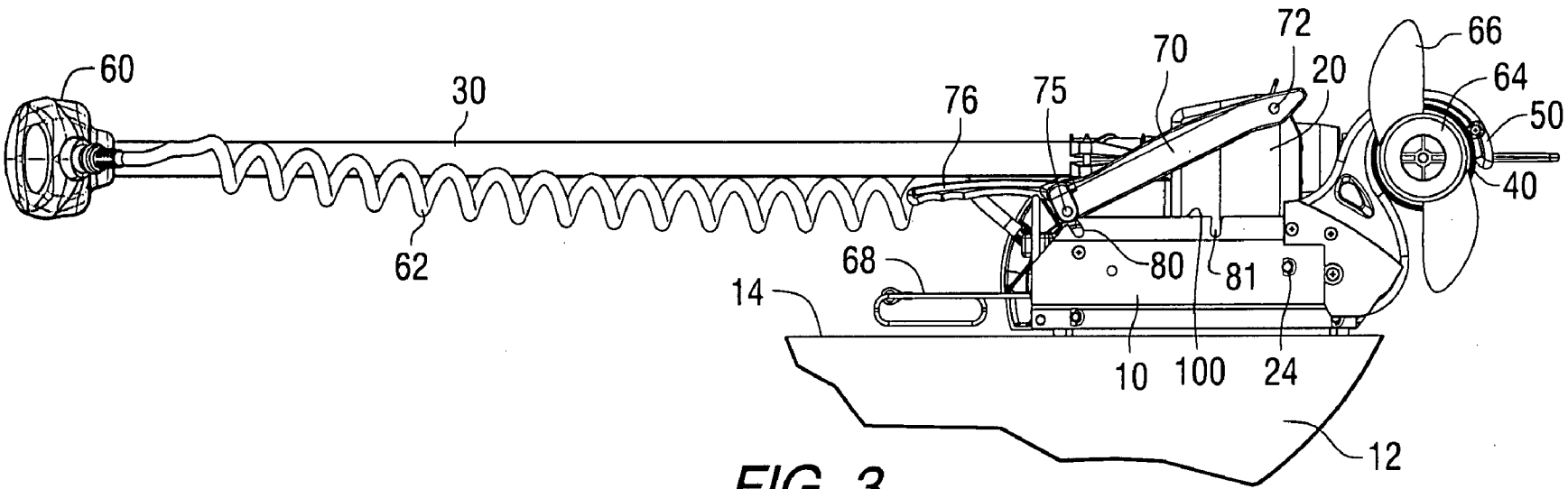
FIG. 3 shows a trolling motor after being unlocked from its stowed position.

FIG. 3 is generally similar to FIGS. 1 and 2, but shows the latch component 70 rotated about its release axis 72 in a clockwise direction in FIG. 3. This unlatching direction of rotation is identified by arrow E in FIG. 2. As can be seen, the latching surface of pin 75, which is attached to the latch component 70, is removed from the first slot 80 in the base 10. This movement of the latching surface of pin 75 out of the first slot 80 is accomplished by manually raising the grip portion 76 of the latch component 70 to cause the latch component 70 to rotate in a clockwise direction about the release axis 72. When in the state shown in FIG. 3, an upward movement exerted on the head 60 or shaft 30, in the direction represented by arrow C in FIG. 2, will cause the motor 40 to move downwardly and out of the cradle 50. It can be seen that no motion of the shaft 30 in the direction represented by arrow A in FIG. 2 is necessary to accomplish this unlatching procedure.

Figure 4:
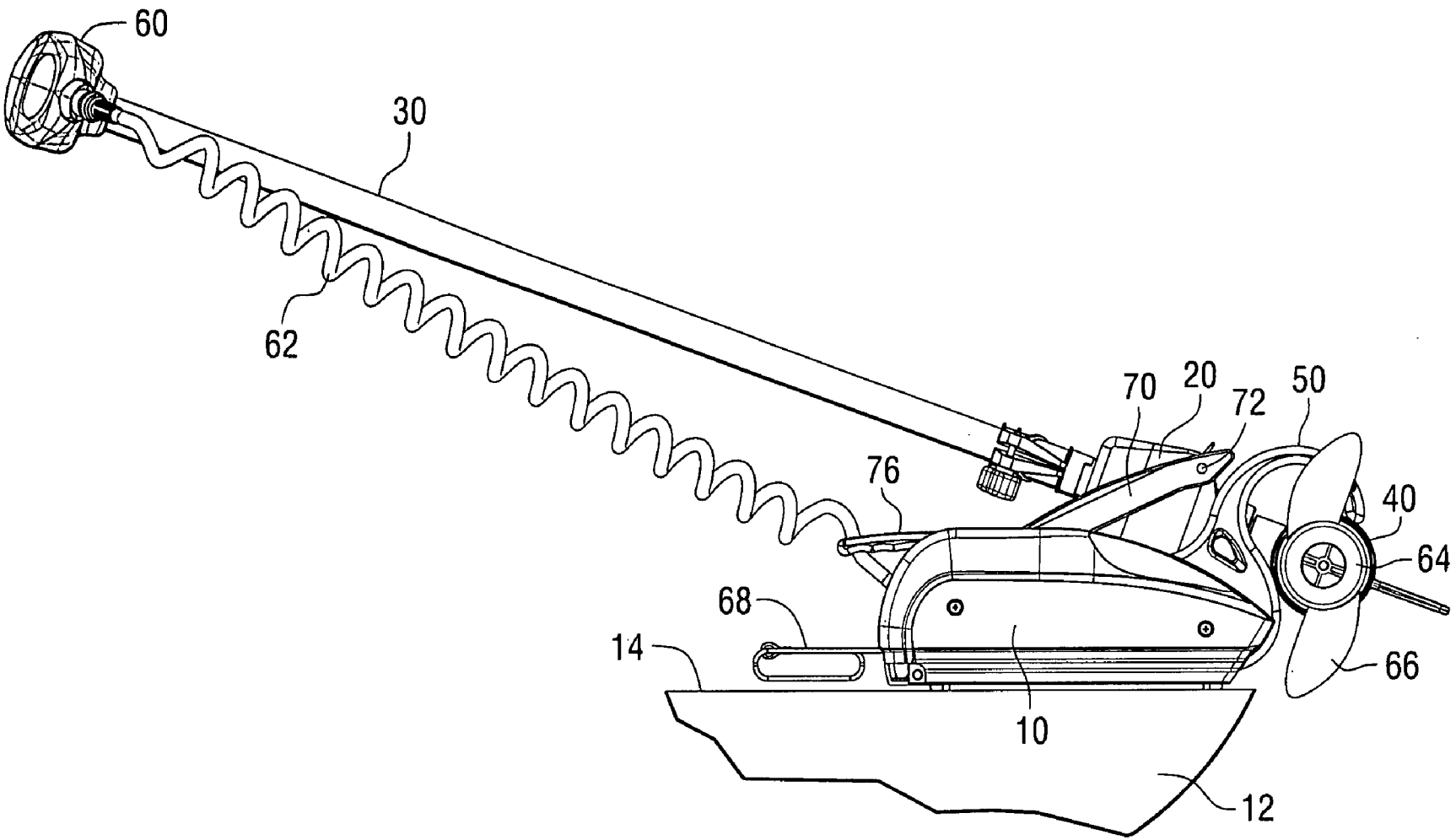
FIG. 4 shows the trolling motor with the shaft rotated about a pivot axis.

With reference to FIGS. 2 and 4, it can be seen that continued movement of the shaft 30 in the direction identified by arrow C in FIG. 2 causes continued rotation of the transmission structure 20 about the pivot axis 24. This continued rotation also causes the motor 40 to move downwardly and away from the cradle 50. Although not visible in FIG. 4, it should be understood that the latching surface of the latch component 70 remains out of the first slot 80. In fact, continued rotation of the shaft 30 about the pivot axis 24 causes the latching surface of the latch component 70 to move toward the right, away from the first slot 80, and toward the second slot 81 of the second retention mechanism 42 which is described above in conjunction with FIG. 2.

Figure 5:
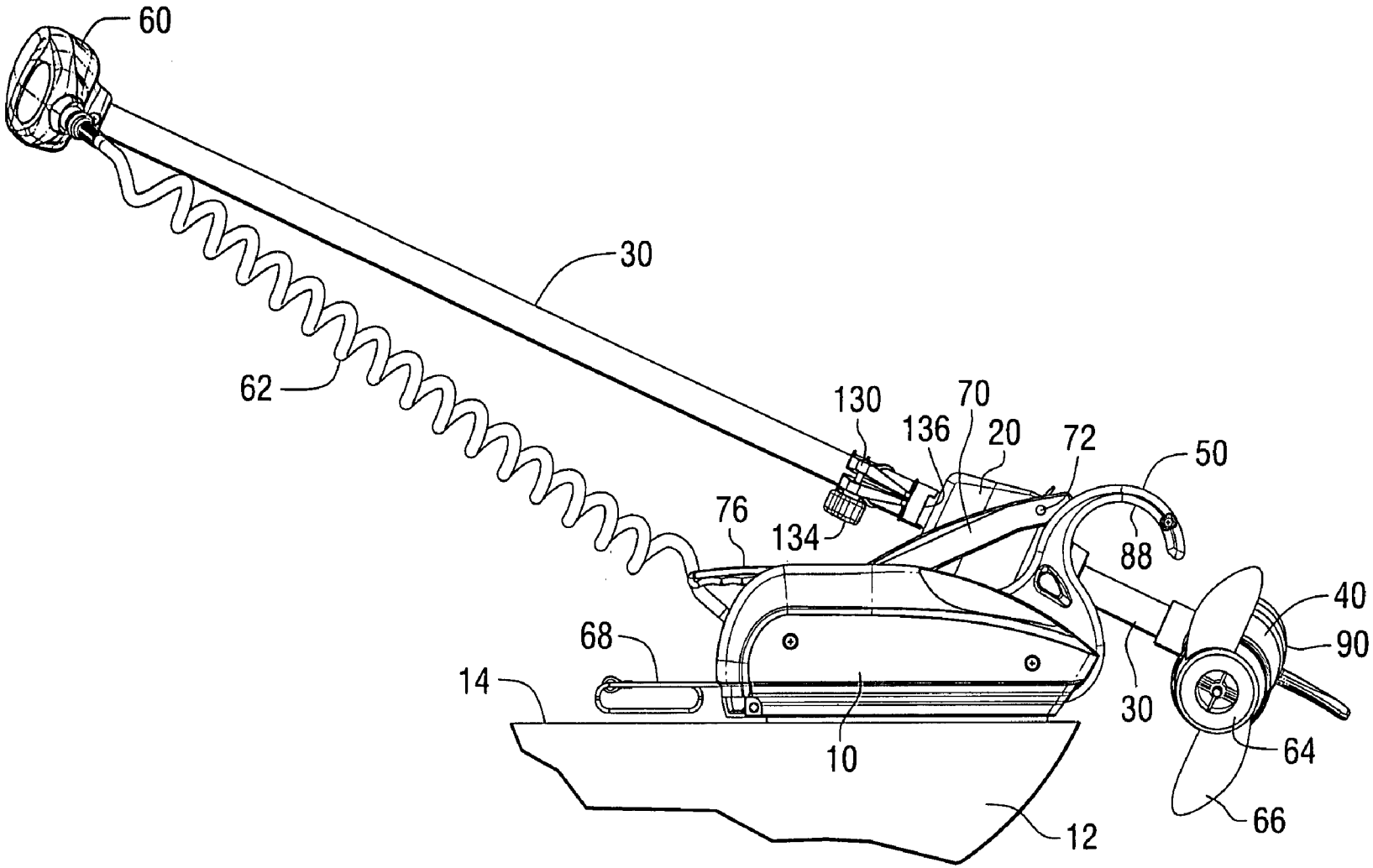
FIG. 5 shows a subsequent position of the trolling motor after the shaft and motor have been rotated about a central axis and translated along the central axis, of the shaft in comparison to FIG. 4.

FIG. 5 shows the motor 40 displaced from the cradle 50. As can be seen, the cradle structure 50 is shaped to receive the motor therein when the shaft is in the stowed position, as illustrated in FIGS. 1-3. The cradle structure 50 comprises an internal receiving surface 88 which has a radius of curvature which is smaller than the outer surface of the motor 40. The cradle structure 50, in a particularly preferred embodiment of the present invention, comprises at least one arm which is sufficiently flexible to accommodate the outer surface 90 of the motor 40 being larger than the radius of curvature of the internal receiving surface 88 of the cradle structure 50. This flexibility allows the cradle structure 50 to expand to receive the motor 40 with a slight gripping force exerted on the outer surface 90 of the motor.

Figure 6:
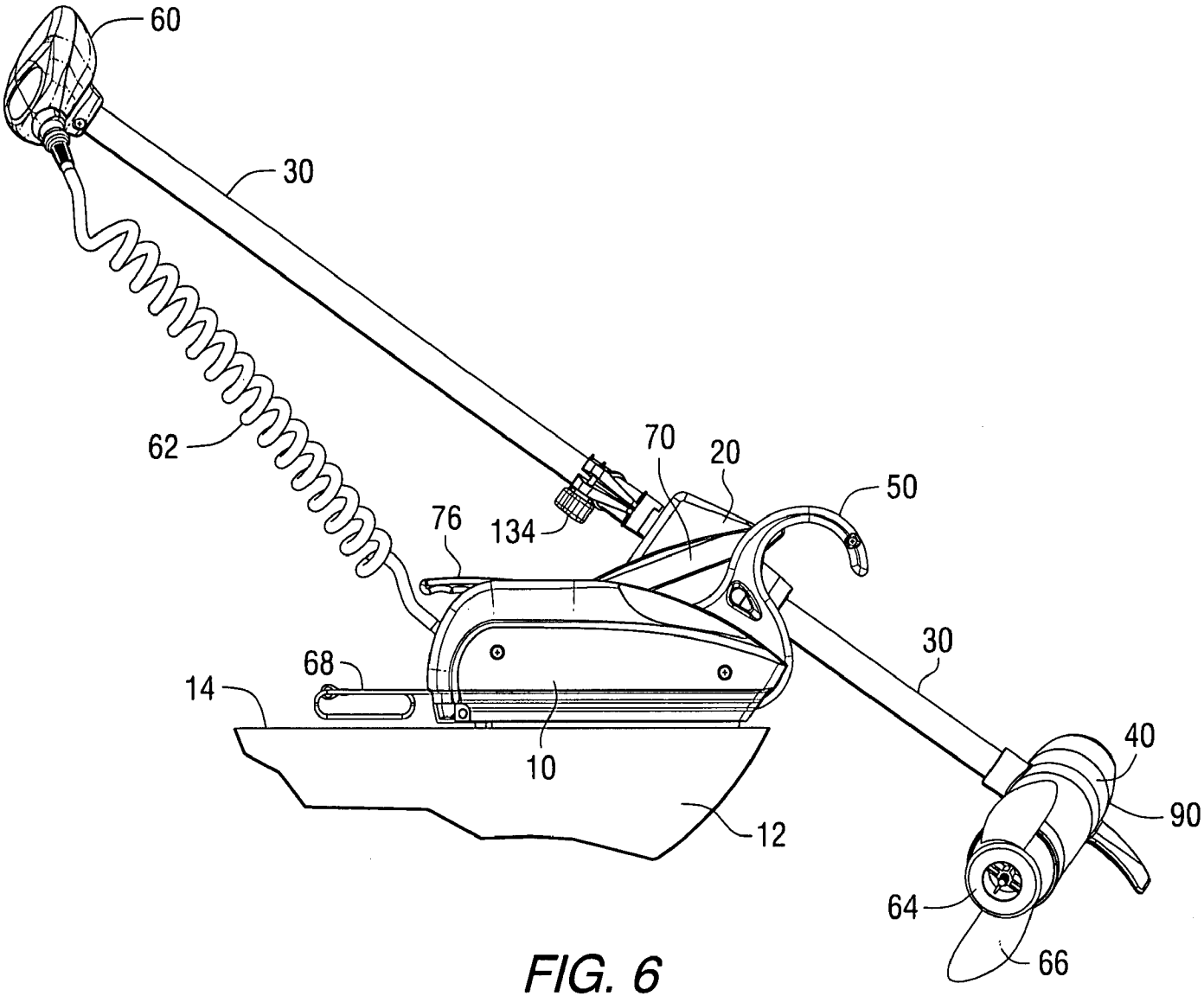
FIG. 6 shows a slight additional rotation about the pivot axis, translation along the shaft axis, and rotation of the trolling motor about the shaft axis in comparison to FIG. 5.

With reference to FIGS. 2 and 6, continued rotation of the shaft 30 in the direction identified by arrow C in FIG. 2 causes the motor 40 to move farther from the cradle structure 50. In addition, this rotation in the direction of arrow C is accompanied by a linear movement of the shaft 30 relative to the transmission structure 20 in the direction generally identified by arrow A in FIG. 2. To accommodate this linear motion, the shaft 30 is slidably supported by the transmission structure 20.

Figure 7:
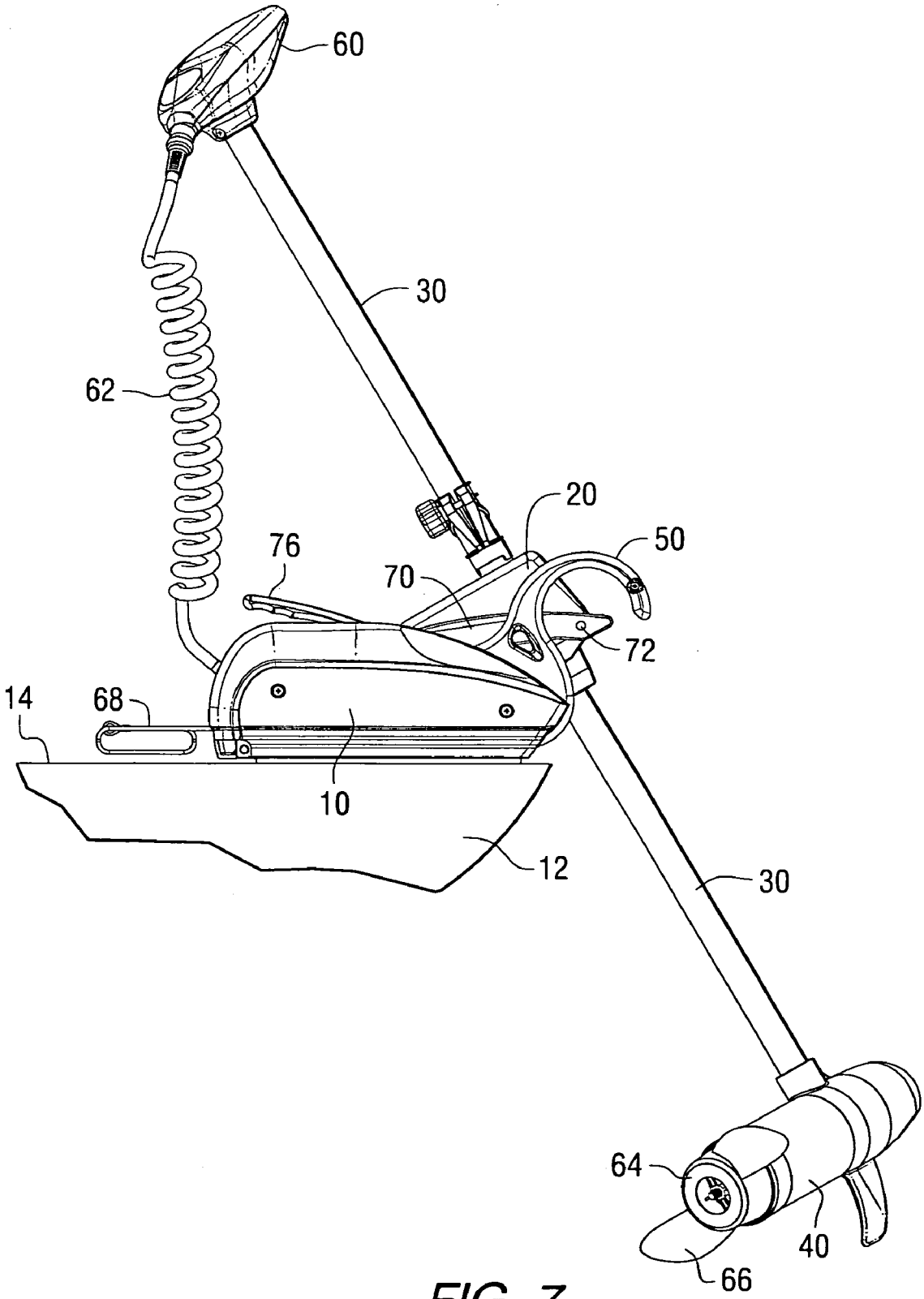
FIG. 7 shows a further set of rotations and translation in comparison to FIG. 6.

FIG. 7 shows the state of the trolling motor mount apparatus after further rotation of the shaft 30 in the direction identified by arrow C in FIG. 2. In FIG. 7, it can be seen that the transmission structure 20 has rotated significantly about the pivot axis 24, which is shown in FIG. 2, along with the latch component 70 which is attached to the transmission structure 20 at the release axis 72. In addition, continued linear motion of the shaft 30 relative to the transmission structure 20, as represented by arrow A in FIG. 2, lowers the electric motor 40 away from the cradle structure 50.

Figure 8:
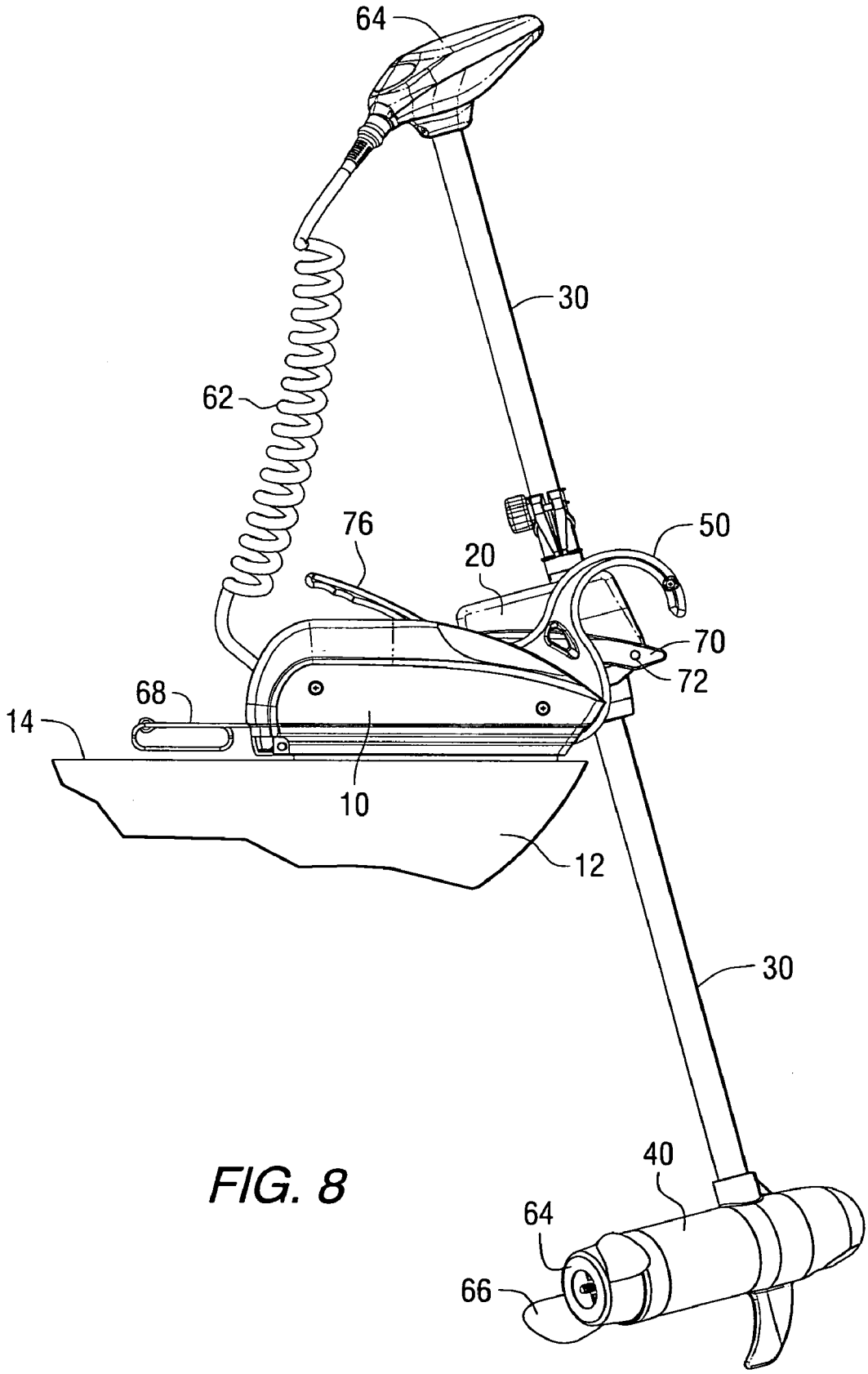
FIG. 8 shows a further set of rotations and translation in comparison to FIG. 7.
Figure 9:
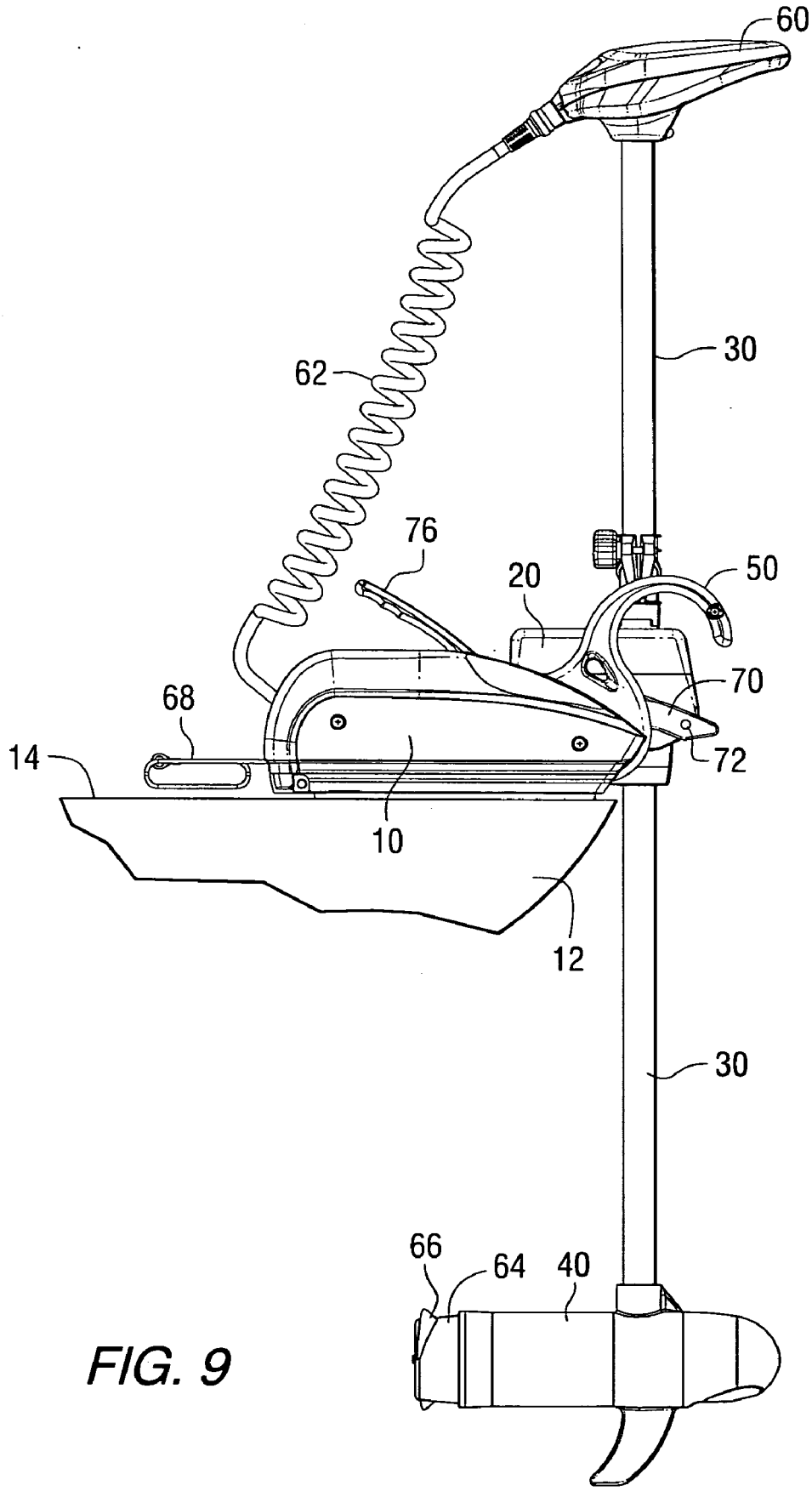
FIG. 9 shows the trolling motor in a deployed location without the latch engaged.

FIGS. 8 and 9 show the trolling motor assembly in ladder stages of deployment. When completely deployed, the shaft 30 is generally vertical and the latching surface of the latch component 70 is disposed in the second slot 81. In order to further describe this relationship of components, FIGS. 10 and 11 show the internal movement of the components with the cover 13 removed from the base 10.

Figure 10:
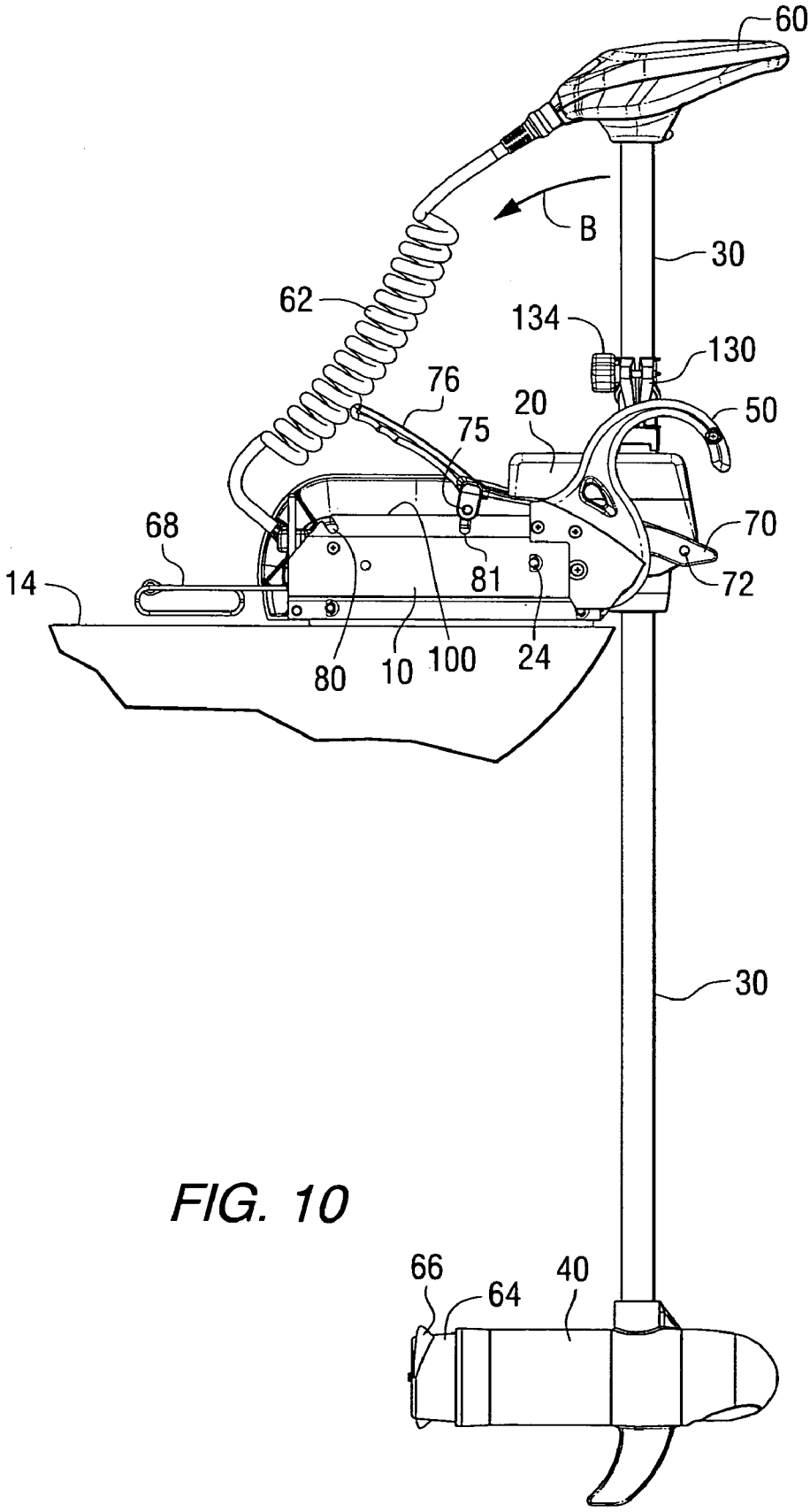
FIG. 10 is generally similar to FIG. 9, but with a cover removed from the base to show internal components.

In FIG. 10, the pin 75 of the latching surface is not yet disposed within the second slot 81 of the base 10. Further rotation, in a counter clockwise direction, of the latch component 70 about the release axis 72 is necessary to move the latching surface into the second slot 81 in order to lock the shaft 30 in the position generally shown in FIG. 10. In FIG. 11, the latching surface of pin 75 is moved downwardly into the second slot 81 to accomplish this latching function. A spring, not shown in FIGS. 10 and 11, is provided to urge the latch component 70 in a counterclockwise direction about the release axis 72. This urging of the latch component 70 tends to cause the latching surface of pin 75 to move into either the first or second slots, 80 or 81, when the pin 70 is near the open end of either of those slots. As a result, the spring that urges this counterclockwise rotation of the latch component 70 tends to facilitate the locking procedure whenever the latching surface of pin 75 nears either of the two slots, 80 and 81.

Figure 11:
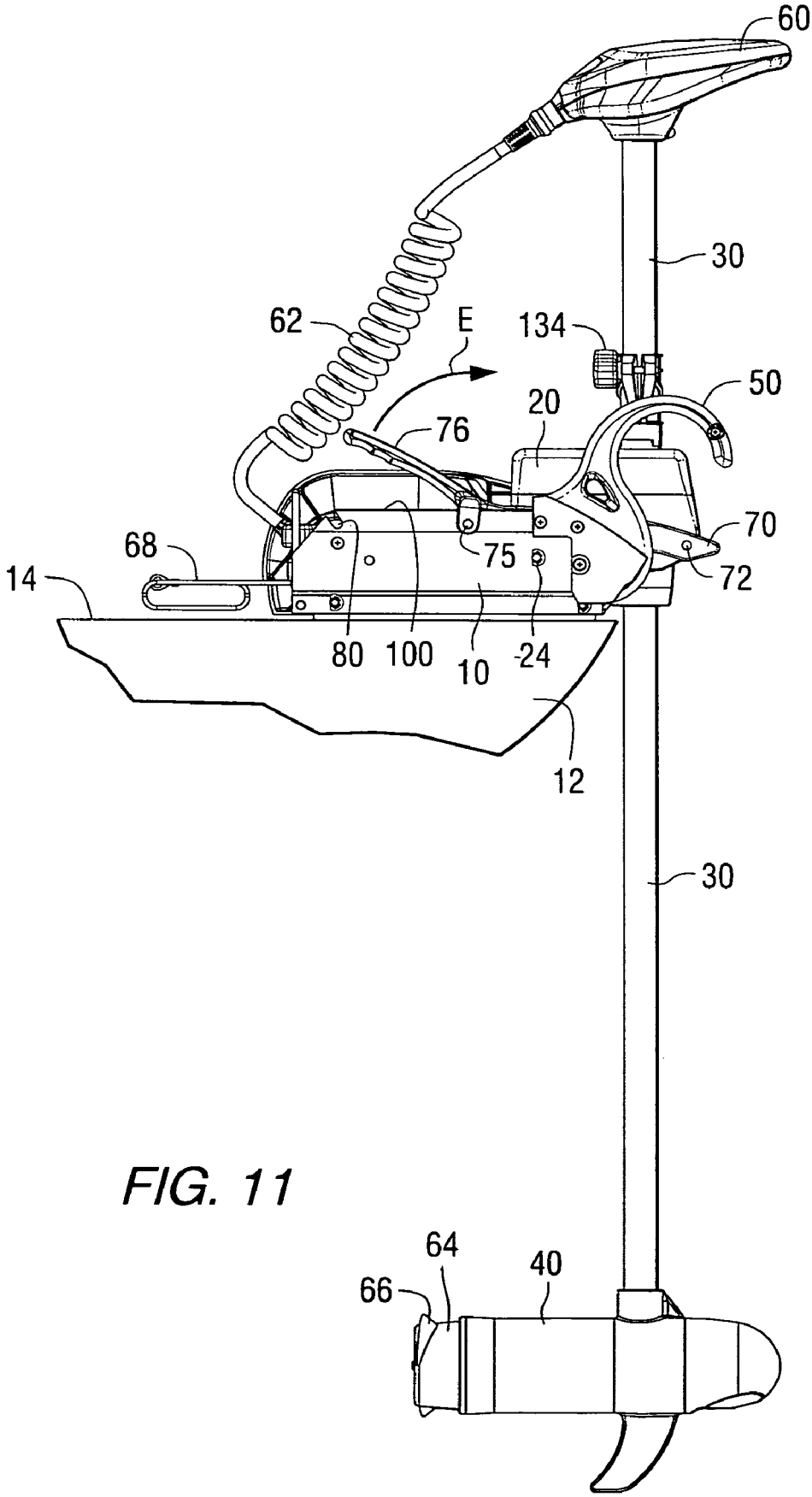
FIG. 11 shows the trolling motor locked in its deployed position.

FIG. 11 shows the pin 75 of the latching surface disposed within the second slot 81, locking the shaft 30 in its deployed position. By comparing FIGS. 2, 3, 10 and 11, it can be seen that the downward force on the latch component 70, as represented by arrow D in FIG. 2, causes the latching surface of pin 75 to move into the first and second slots, 80 and 81, when the latching surface is near the open end of either of those slots. In addition, this downward force exerted on the latch component 70 causes the latching surface to slide along the edge 100 as it moves back and forth between the first and second slots, 80 and 81. This characteristics of the present invention allows the trolling motor mount to be locked in position, in either the stowed position shown in FIG. 2 or the deployed position shown in FIG. 11, without the need for the shaft 30 to be rotated about its centerline 32 which is shown in FIG. 2. A simple rotation of the shaft 30 about the pivot axis 24 is sufficient to cause the latching surface of pin 75 to move into the first or second slot, 80 or 81, and lock the trolling motor shaft 30 into its stowed or deployed positions, respectively.

Figure 13:
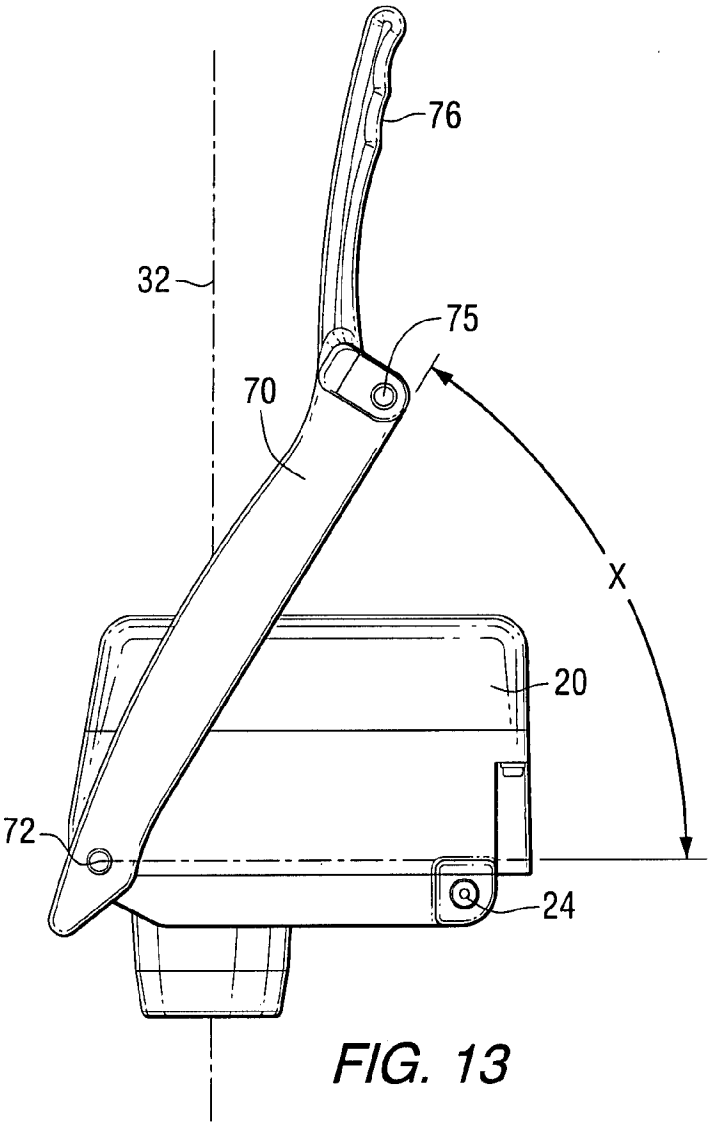
FIGS. 12 and 13 show the transmission structure in isometric and side views.
Figure 12:
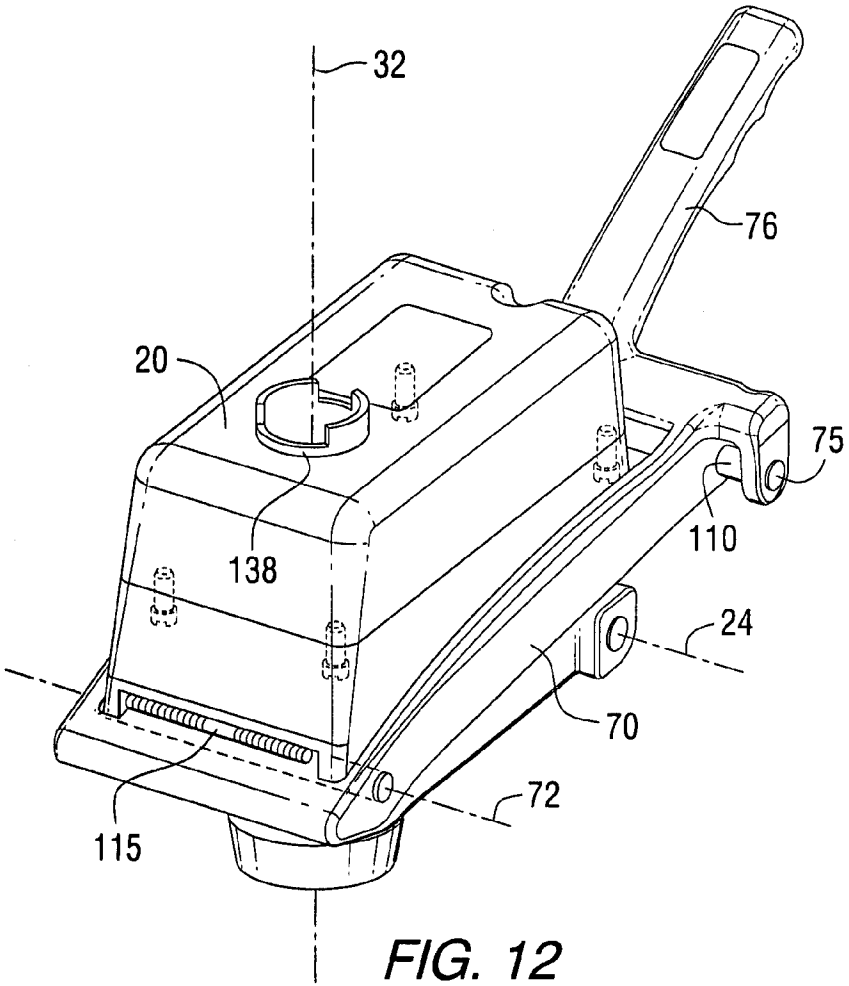

FIGS. 12 and 13 show an isometric and side view of the transmission structure 20. These illustrations show the pivot axis 24, the release axis 72, the latch component 70, the handle 76 and the latching surface 110 which is an external surface of the pin 75. In FIG. 12, the spring structure 115 is illustrated. This spring urges the latch component 70 in a clockwise direction, as viewed in FIG. 13, toward the position shown in FIG. 12. For purposes of reference, the position of the central axis 32 of the shaft, as identified by reference 30 in FIGS. 2, 3, 10 and 11, is illustrated. Also, the range of movement of the latch component 70 is identified by arrow X in FIG. 13.

With reference to FIGS. 2, 3, 10 and 11, the procedure for changing the trolling motor position from its deployed position in FIG. 11 to its stowed position in FIG. 2 involves the steps of raising the handle 76 of the latch component 70, as represented by arrow E in FIG. 11, to move the latching surface of pin 75 out of the second groove 81.

With continued reference to FIGS. 2, 3, 10 and 11, and beginning with the position of the shaft 30 shown in FIG. 11, a movement of the handle 76 in the direction identified by arrow E in FIG. 11, moves the latching surface of pin 75 out of the second groove 81 as shown in FIG. 11. It should be understood the only difference between FIGS. 10 and 11 is that the handle 76 is raised slightly in FIG. 10 as a result of the operator providing the upward movement described above. This moves the latching surface out of the second groove 81 and allows the shaft 30 to be pivoted about the pivot axis 24 in synchrony with the transmission structure 20. With the latching surface of pin 75 out of the second groove 81, the operator can rotate the shaft 30 about the pivot axis 24 in the direction of arrow B. This causes the latching surface to slide along the upper edge 100 which exists between the first and second grooves, 80 and 81. For purposes of reference, this movement of the shaft 30 in the direction represented by arrow B is sequentially illustrated in FIGS. 8, 7, 6, 5 and 4. As the operator causes the shaft 30 to rotate in the direction represented by arrow B, the shaft 30 is also rotated about its central axis 32 and translated along its central axis 32. This rotation of shaft 30 about its central axis 32 and translation along its central axis 32 is done so that the motor 40 rotates and translates to become aligned with the opening provided by the arms of the cradle structure 50. However, it should be understood that the latching procedure, which locks the transmission structure 20 to the base 10, does not require any rotation of the shaft 30 or linear movement of the shaft 30 in the direction represented by arrow A in FIG. 2. The present invention provides a locking procedure that only requires a lever movement of the shaft 30 in the direction represented by arrow B in FIG. 2. The cradle provides stability in rotation about the central axis 32 and translation along the central axis 32 after it engages in the final range of motion about the pivot axis 24.

With reference to FIGS. 2 and 3, the final stages of the locking procedure occur when the latching surface of pin 75 is located at the opening of the first slot 80, as illustrated in FIG. 3. Further movement of the shaft 30 in the direction represented by arrow B in FIG. 2, causes this latching surface to move into the first slot 80 under the urging of the spring 115 described above in conjunction with FIG. 12. This accounts for the sequential change in position from the condition shown in FIG. 3 to the condition shown in FIG. 2. When the latching surface of pin 75 moves into the first slot 80, the transmission structure 20 is locked to the base 10 and the trolling motor is locked in its stowed position shown in FIG. 2.

With reference to FIGS. 1-13, a height locking member 130 is shown associated with the shaft 30. The height locking member 130 is provided with a threaded knob 134 that allows it to be tightened relative to the outer surface of the shaft 30. When tightened in this manner, the height locking member 130 is rigidly attached to the shaft 30 and stops the descent of the shaft relative to the transmission structure 20 in order to select an appropriate height of the motor 40 relative to the base 10. When the knob 134 is not tightened, the height locking member 130 can slide on the shaft 30. It should be understood that the height locking member 130 is not a required component of the present invention. The height locking member 130 is also configured to have depressions 136 which are shaped to be received in depressions 138 of the transmission structure 20. These discontinuities allow the height locking member 130 to be locked in rotational position to the shaft 30 and to the gear mechanism inside the transmission structure 20.

With continued reference to FIGS. 1-13, it can be seen that a trolling motor mount apparatus made in accordance with a preferred embodiment of the present invention, comprises a base 10 which is attachable to a marine vessel 12. A transmission structure 20 is pivotally attached to the base 10 for rotation about a pivot axis 24. A shaft 30 is supported by the transmission structure 20 for movement, relative to the transmission structure in a direction A which is generally parallel to a central axis 32 of the shaft 30. A motor 40 is attached to the shaft 30 and a first retention mechanism 41 is provided for retaining the shaft 30 in a stowed position (illustrated in FIG. 2) relative to the base 10. The first retention mechanism 41 is lockable in the stowed position by movement of the shaft in a first rotational direction B about the pivot axis 24. The pivot axis 24 extends through the transmission structure 20 in a preferred embodiment of the present invention. The pivot axis 24 is disposed in non-intersecting relation with the central axis 32 in a preferred embodiment of the present invention. A cradle structure 50 is shaped to receive the motor 40 therein when the shaft 30 is in the stowed position. The cradle structure comprises an internal receiving surface 88 which has as radius of curvature which is smaller than an outer surface 90 of the motor 40, in a particularly preferred embodiment of the present invention. The cradle structure 50 comprises at least one arm which is sufficiently flexible to accommodate the outer surface 90 of the motor 40 being larger than the radius of curvature of the internal receiving surface 88. The cradle 50 locks the lower unit from rotating about the central shaft axis 32 and locks the translation along the central axis 32 in the stowed position. The cradle also acts as a second rotation lock about the pivot axis 24.

A second retention mechanism 42 is provided for retaining the shaft 30 in a deployed position (as illustrated in FIG. 11) relative to the base 10. The second retention mechanism 42 is lockable in the deployed position by movement of the shaft 30 in a second rotational direction C about the pivot axis in a preferred embodiment of the present invention. The first and second retention mechanisms, 41 and 42, are configured to be actuated to retain the shaft 30 in the stowed and deployed positions, respectively, solely by movement of the shaft 30 in the first and second rotational directions (identified by arrows B and C in FIG. 2) about the pivot axis 24, respectively, without the need for the shaft 30 to be moved in the direction A which is generally parallel to the central axis 32. A latch component 70 is attached to the transmission structure 20 for movement about a release axis 72. The latch component 70 comprises a latching surface 110 which is shaped to be received in a first slot 80 formed in the base 10 when the latch component 70 is rotated in a latching direction D about the release axis 72 and is also shaped to be removed from the first slot 80 when the latch component 70 is rotated in an unlatching direction E about the release axis 72. A spring 115 is provided for urging the latch component 70 in the latching direction D.

Although the present invention has been described in particular detail and illustrated to show a preferred embodiment, it should be understood that alternative embodiments are also within its scope.

I claim:

1. A trolling motor mount apparatus, comprising:

a base which is attachable to a marine vessel;

a transmission structure which is pivotally attached to said base for rotation about a pivot axis;

a shaft supported by said transmission structure for movement, relative to said transmission structure, in a direction which is generally parallel to a central axis of said shaft;

a motor attached to said shaft;

a first retention mechanism for retaining said shaft in a stowed position relative to said base, said first retention mechanism being lockable in said stowed position by movement of said shaft in a first rotational direction about said pivot axis; and a latch component pivotally attached to said transmission structure for movement about a release axis, said latch component comprising a latching surface which is shaped to be received in a first slot formed in said base when said latch component is rotated in a latching direction about said release axis and shaped to be removed from said first slot when said latch component is rotated in an unlatching direction about said release axis.

2. The mount apparatus of claim 1, wherein:

said pivot axis extends through said transmission structure.

3. The mount apparatus of claim 1, wherein:

said pivot axis is disposed in nonintersecting relation with said central axis.

4. The mount apparatus of claim 1, further comprising:

a cradle structure shaped to receive said motor therein when said shaft is in said stowed position.

5. The mount apparatus of claim 4, wherein:

said cradle structure comprises an internal receiving surface which has a radius of curvature which is smaller than an outer surface of said motor.

6. The mount apparatus of claim 5, wherein:

said cradle structure comprises at least one arm which is sufficiently flexible to accommodate said outer surface of said motor being larger than said radius of curvature of said internal receiving surface.

7. The mount apparatus of claim 1, further comprising:

a second retention mechanism for retaining said shaft in a deployed position relative to said base, said second retention mechanism being lockable in said deployed position by movement of said shaft in a second rotational direction about said pivot axis.

8. The mount apparatus of claim 7, wherein:

said first and second retention mechanisms are configured to be actuated to retain said shaft in said stowed and deployed positions, respectively, solely by movement of said shaft in said first and second rotational directions about said pivot axis, respectively, without the need for said shaft to be moved in said direction which is generally parallel to said central axis.

9. The mount apparatus of claim 1, wherein:

said latch component comprises a latching surface which is shaped to be received in a second slot formed in said base when said latch component is rotated in a latching direction about said release axis and shaped to be removed from said second slot when said latch component is rotated in an unlatching direction about said release axis.

10. The mount apparatus of claim 9, further comprising:

a spring for urging said latch component in said latching direction.

11. A trolling motor mount apparatus, comprising:

a base which is attachable to a marine vessel;

a transmission structure which is pivotally attached to said base for rotation about a pivot axis;

a shaft supported by said transmission structure for movement, relative to said transmission structure, in a direction which is generally parallel to a central axis of said shaft;

a motor attached to said shaft;

a first retention mechanism for retaining said shaft in a stowed position relative to said base, said first retention mechanism being lockable in said stowed position by movement of said shaft in a first rotational direction about said pivot axis;

a cradle structure shaped to receive said motor therein when said shaft is in said stowed position;

a second retention mechanism for retaining said shaft in a deployed position relative to said base, said second retention mechanism being lockable in said deployed position by movement of said shaft in a second rotational direction about said pivot axis, said first and second retention mechanisms being configured to be actuated to retain said shaft in said stowed and deployed positions, respectively, solely by movement of said shaft in said first and second rotational directions about said pivot axis, respectively, without the need for said shaft to be moved in said direction which is generally parallel to said central axis;

a latch component pivotally attached to said transmission structure for movement about a release axis, said latch component comprising a latching surface which is shaped to be received in a first slot formed in said base when said latch component is rotated in a latching direction about said release axis and shaped to be removed from said first slot when said latch component is rotated in an unlatching direction about said release axis.

12. The mount apparatus of claim 11, further comprising:

a spring for urging said latch component in said latching direction.

* * * * *